US012637242B2

(12) United States Patent
Brandenburger

(10) Patent No.: US 12,637,242 B2
(45) Date of Patent: May 26, 2026

(54) SYSTEM AND METHOD FOR FILLING POUCHES WITH A MEDICAL LIQUID

(71) Applicant: Fresenius Kabi Deutschland GmbH, Bad Homburg (DE)

(72) Inventor: Torsten Brandenburger, Bad Homburg (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 0 days.

(21) Appl. No.: 18/730,673

(22) PCT Filed: Feb. 3, 2023

(86) PCT No.: PCT/EP2023/052662
§ 371 (c)(1),
(2) Date: Jul. 19, 2024

(87) PCT Pub. No.: WO2023/148321
PCT Pub. Date: Aug. 10, 2023

(65) Prior Publication Data

US 2025/0171171 A1 May 29, 2025

(30) Foreign Application Priority Data

Feb. 4, 2022 (EP) ..... 22155202

(51) Int. Cl.

| | |
|---|---|
| ***B65B 3/00*** | (2006.01) |
| ***B65B 3/04*** | (2006.01) |
| ***B65B 39/00*** | (2006.01) |
| ***B65B 39/12*** | (2006.01) |

(52) U.S. Cl.
CPC ..... *B65B 3/003* (2013.01); *B65B 3/045* (2013.01); *B65B 39/12* (2013.01); *B65B 2039/009* (2013.01)

(58) Field of Classification Search
CPC ..... B65B 1/18; B65B 3/17; B65B 3/045
See application file for complete search history.

(56) References Cited

U.S. PATENT DOCUMENTS 4,693,052 A * 9/1987 Rebmann ..... B65B 55/025 198/860.3
5,305,809 A * 4/1994 Pringle ..... B67C 3/22 141/237

(Continued)

FOREIGN PATENT DOCUMENTS

CN 111717870 A 9/2020
KR 20050118321 A 12/2005

(Continued)

OTHER PUBLICATIONS

International Search Report dated Jun. 28, 2023 issued in PCT/EP2023/052662.
Written Opinion dated Jun. 28, 2023 issued in PCT/EP2023/052662.

*Primary Examiner* — Timothy L Maust
(74) *Attorney, Agent, or Firm* — Blank Rome LLP

(57) ABSTRACT

A system for filling bags with a medical liquid is described. The system includes filling nozzles laterally mutually spaced from one another. The components of a medical liquid can be filled in a bag via one port each using the filling nozzles. A first filling nozzle is laterally movable with respect to at least one other filling nozzle.

19 Claims, 6 Drawing Sheets

(56) References Cited

U.S. PATENT DOCUMENTS

| | | | | |
|---|---|---|---|---|
| 7,875,015 | B2 * | 1/2011 | Pahlberg | B65D 81/3266 604/416 |
| 10,377,519 | B2 | 8/2019 | Brandenburger et al. | |
| 2010/0037987 | A1 * | 2/2010 | Gustafsson | B65B 39/08 141/311 A |

FOREIGN PATENT DOCUMENTS

| | | | |
|---|---|---|---|
| WO | 2006010411 | A1 | 2/2006 |
| WO | 2015044088 | A1 | 4/2015 |

* cited by examiner

SYSTEM AND METHOD FOR FILLING POUCHES WITH A MEDICAL LIQUID

CROSS-REFERENCE TO RELATED APPLICATIONS

This application is a U.S. National Stage Application of International Patent App. No. PCT/EP2023/052662, filed Feb. 3, 2023, which claims foreign priority to European Patent Application No. 22155202.9, filed Feb. 4, 2022, the disclosures of which are hereby incorporated by reference herein in their entireties.

FIELD OF THE INVENTION

The invention relates to an installation and a method for filling bags with a medical liquid. In particular, the invention relates to the aseptic filling of bags with an infusion solution, in particular with an infusion solution for parenteral nutrition.

BACKGROUND OF THE INVENTION

An installation for aseptically filling bags with a medical liquid is known from the published patent application WO 2015/044088 A1. According to the teaching of this document, the medical bag is filled under a protective atmosphere of nitrogen. This allows the filling process to be carried out in an aseptic environment. In this case, it may be possible to dispense with sterilising the bags in an autoclave.

Multi-chamber bags are used for parenteral nutrition compositions. Such multi-chamber bags are used in particular for infusion solutions for parenteral nutrition. The components of the nutritional solution, in particular carbohydrates, fats and amino acids as well as liquid with electrolytes, vitamins and trace elements are thereby filled into separate chambers of a bag.

Only immediately before the bag is used are the components mixed by opening pull-open weld seams between the individual chambers, for example by rolling and pressing the bag. The tear-open seams which separate the individual chambers from each other are designed to be torn open accordingly. A possible configuration of the seams is represented, for example, in WO 2006/010411 A1.

The different infusion solutions and the sometimes very different volumes mean that such infusion bags are available in a variety of designs, in which the ports for filling and removing liquid in particular have different spacings. In particular in paediatrics, three-chamber bags are used for a parenteral nutrition solution with a total volume of 500 ml or less.

It is therefore currently hardly possible to provide a single filling station that can be used for a large number of multi-chamber bags with different volumes without retrofitting.

OBJECT OF THE INVENTION

The invention is therefore based on the object of at least reducing the aforementioned disadvantages of the prior art.

It is in particular an object of the invention to provide an installation for filling bags with a medical liquid, with which multi-chamber, in particular three-chamber bags can be filled, which have different volumes and possibly have a different port spacing from one another.

SUMMARY OF THE INVENTION

The object of the invention is already achieved by an installation for filling bags with a medical liquid and by a method for aseptically filling bags with a medical liquid according to one of the independent claims.

Preferred embodiments and further developments of the invention can be inferred from the subject matter of the dependent claims, the description and the drawings.

The invention relates to an installation for filling bags with a medical liquid, with the installation comprising at least three, in particular four, filling nozzles which are arranged next to one another and laterally spaced apart from one another, with the components of a medical liquid being able to be filled into the bag or into a chamber of a bag via a port by means of the filling nozzles, with a first filling nozzle being able to be moved laterally relative to at least one further filling nozzle.

According to the invention, a filling nozzle can be adjusted in such manner that the installation can be adjusted, in particular automatically, to a different port spacing. In this way, starting from one valve block, the medical liquid can be filled into at least two, preferably exactly two different port receptacles. Such an installation can be used to fill in particular different multi-chamber bags, for example two- and three-chamber bags.

In particular, the installation is used for filling infusion bags, preferably infusion bags with a parenteral nutrition composition.

As described above, a multi-chamber bag comprises at least two, in particular three chambers, which are filled with a different medical liquid. For example, a first chamber is filled with a lipid emulsion, a second chamber with an amino acid solution and/or a third chamber with a glucose solution. This could, for example, be an electrolyte solution. The different components are only mixed together immediately before the bag is used by opening pull-open weld seams that separate the chambers from each other.

Such a bag is preferably designed as a film bag. In particular, an infusion bag is made of two films welded together.

The bag comprises at least two ports. The port can form the lower part of a connector, with the upper part fixing a sealing element with which the port is closed.

The upper part can comprise a break-off part. After breaking off the break-off part, the sealing element can be pierced with a needle or a spike to remove or inject liquid.

The connector can, for example, be designed to be connected to a transfer set. Removal generally takes place by inserting a spike which is connected to a transfer set or a transfer system.

The lower part can be welded into the bag, in particular in a transverse weld seam of the bag. For this purpose, the lower part can, for example, have an elongated, in particular boat-like, shape.

One connector is typically used to remove liquid, whereas another connector can optionally be used to add liquid, for example to transfer a drug into the medical liquid. The injection, for example of an active ingredient, can be carried out in particular by means of a needle syringe.

The installation has receptacles for holding the ports. According to one embodiment of the invention, the bag is gripped via the receptacles at the ports and then filled via the ports. After filling, the ports are closed with the upper part and are then sealed.

When filling a three-chamber bag, there is usually a blind port in addition to an injection port and a removal port. This is only used to fill the bag or a chamber of the bag. After filling, it is closed with a cap and a sealing element and is not used any further.

According to a preferred embodiment, the filling nozzle can be moved laterally by means of a drive. The drive can in particular be designed as an electric, pneumatic or hydraulic drive. According to this embodiment of the invention, an automated adjustment of the port spacing is made possible.

According to a preferred embodiment, the installation comprises one more receptacle for each port than there are filling nozzles. In particular, the installation can comprise five receptacles and four filling nozzles. The installation has a number of receptacles for each port that is at least one greater than the number of existing filling nozzles.

One, in particular exactly one, of the filling nozzles can be moved laterally. Preferably, this is a filling nozzle arranged on the outside in the order of the nozzles.

The filling nozzle can be moved in at least two, preferably exactly two, positions, with a receptacle for a port of the bag being arranged in the respective, preferably two, positions of the filling nozzle. The receptacle is preferably arranged below the filling nozzle.

In particular, the receptacles can be part of a receiving strip for the bag.

The receiving strip thereby has individual receptacles in the form of recesses adapted to the shape of the lower part of the port.

Preferably, the receptacle comprises a clamp for pressing the port closed, in particular the middle part or neck region of the port. In this embodiment, the port in this section is flexible and can therefore be clamped.

During the filling process, the clamp can serve as a valve to temporarily close the still open port.

For example, the bag can first be flooded with nitrogen before filling. The ports are closed by means of the clamps. The bag is then moved to the filling nozzles and the clamps are opened to fill the bag. Even after filling, the ports can be closed by means of the clamps until the port or ports are closed, in particular by placing the upper part on the lower part of the connector.

The clamp can in particular be part of a clamping strip.

In particular, the installation can comprise a receiving strip for receiving the ports. The ports are locked and held in place by means of a locking strip.

There may also be a movable clamping strip with which the ports are closed.

As described above, the installation is designed for aseptic filling. During the filling process, it is in particular intended that the ports are flushed with a protective gas, in particular nitrogen.

According to one embodiment, the filling nozzles are arranged on a head part which can be moved, in particular vertically, and/or the receptacles for the ports can be moved, in particular vertically.

Depending on the bag, the filling nozzles and the receptacles can be moved to a different spacing from one another, in particular vertically.

The installation can be designed as a rotary installation with a number of stations. For example, the bags can be received in a first station, gassed with nitrogen in a second station, filled in a third station and/or sealed in a fourth station.

The installation is preferably designed to fill at least three, preferably four, differently designed bags. Differently designed bags are bags with a different number and/or a different port spacing.

In particular, the installation can be designed for two different three-chamber bags as well as for three- and/or two-chamber bags. The chambers can have different volumes and/or be filled with different volumes.

The medical liquid is a liquid which is used for medical purposes and is preferably administered intravenously. In a preferred embodiment, the medicinal liquid is an infusion solution. Possible examples of such infusion solutions include

- solutions, emulsions and/or suspensions containing nutrients for parenteral nutrition, in particular lipids, amino acids and/or glucose;
- colloid solutions, in particular for blood replacement therapy (e.g. Voluven®); and/or
- so-called premixed systems in which an active ingredient, e.g. paracetamol, has already been added to the medical liquid.

The invention also relates to the use of the installation described above for producing a bag filled with a medical liquid. In particular, the installation is used to produce an infusion bag filled with a parenteral nutrition composition.

The invention further relates to a method for aseptically filling bags with a medical liquid, in particular using the installation described above, with the method comprising the following steps:

- providing a medical bag which has at least two ports via which the bag is filled with medical liquid by means of at least two filling nozzles, with at least one filling nozzle being moved laterally in order to adjust the spacing from another filling nozzle corresponding to the spacing between the at least two ports.

In particular, a first and a second medical bag can be provided, each having at least two ports via which the second bag is filled with medical liquid by means of the at least two filling nozzles, with the two ports of the first bag having a different spacing from one another than the ports of the second bag.

The method can be used in particular to fill two different three-chamber bags, of which two adjacent ports of one bag have a different spacing compared to the ports of the other bag.

To do this, the filling nozzle is moved from one receptacle to the other.

The first bag can be designed as a three-chamber bag and the second bag as a one- or two-chamber bag.

Preferably, the first and/or second bag is flooded with nitrogen before filling.

Furthermore, during filling of the first and/or second bag, the ports are preferably gassed with nitrogen.

According to one embodiment of the invention, the first bag and/or the second bag can also be evacuated before flooding with nitrogen.

After filling, the ports of the bag are closed with an upper part.

The bag can then be packaged with a secondary bag. The secondary bag can in particular be designed as a tear-open film packaging with sterile contents.

The invention further relates to the use of the method described above for producing a bag filled with a medical liquid. In particular, the method is used to produce an infusion bag filled with a parenteral nutrition composition.

BRIEF DESCRIPTION OF THE DRAWINGS

The subject matter of the invention will be explained in more detail below with reference to the drawings FIG. 1 to FIG. 6.

DETAILED DESCRIPTION OF THE DRAWINGS

Figure 1:
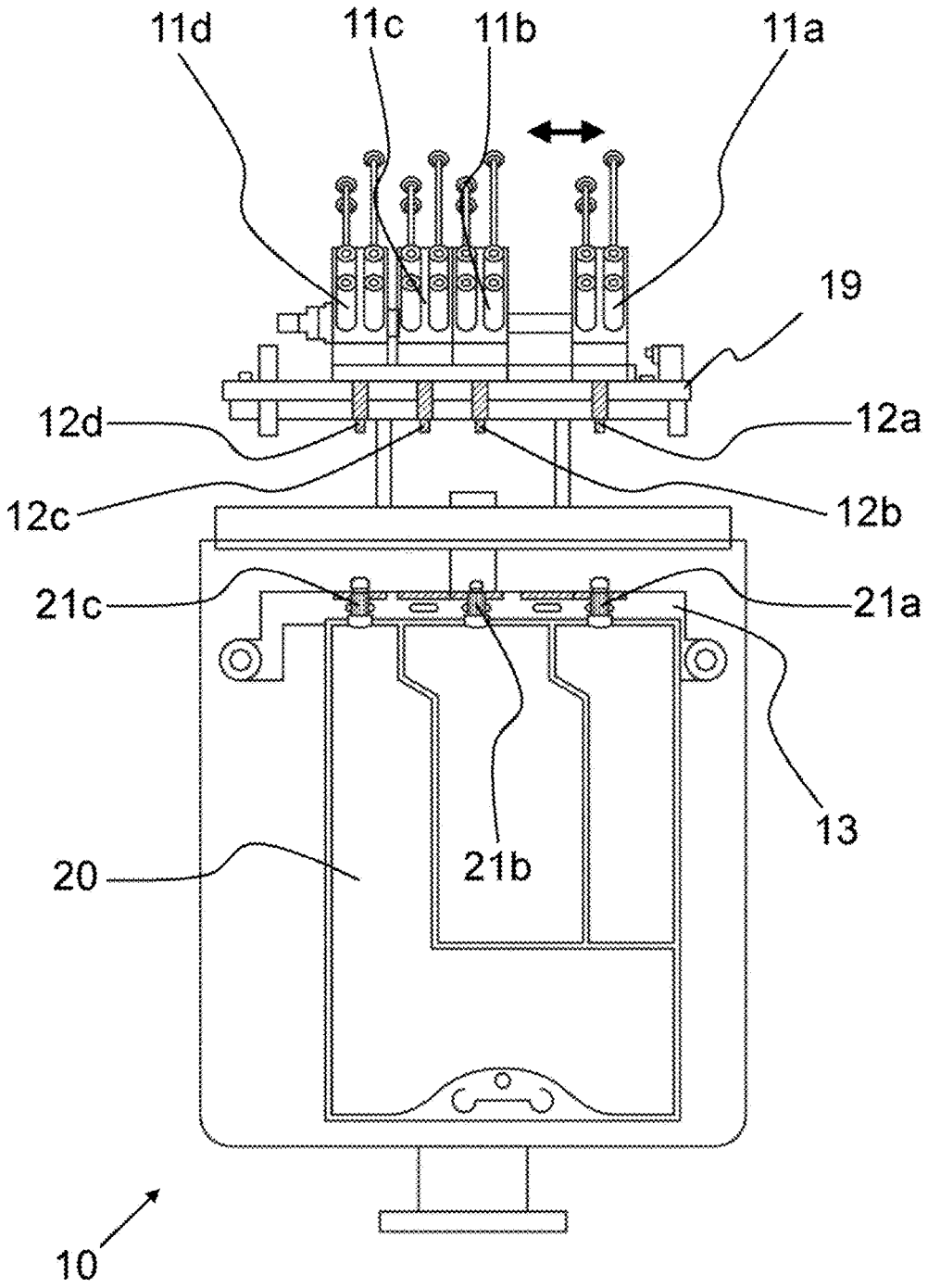
FIG. 1 is a schematic view of a installation for filling a bag from the front.

FIG. 1 shows a schematic view from the front of the components of an installation 10 for filling a bag 20.

The installation 10 comprises a head part 19 with a total of four valve blocks 11*a*-11*d*. Via the valve blocks 11*a*-11*d*, various components of a medical liquid, in particular a parenteral nutrition liquid, can be dosed or filled into the bag 20 via the filling nozzles 12*a*-12*d* using a corresponding hose system.

The head part 19 can be moved vertically together with the valve blocks 11*a*-11*d*.

A holder 13 for the bag 20 is located below the filling nozzles 12*a*-12*d*.

In this exemplary embodiment, the bag 20 is designed as a three-chamber bag with the connectors 21*a* and 21*b* as well as the blind port 21*c*.

The ports 27*a*-27*c* are designed as the lower parts 27*a*-27*c* of the connectors 21*a*, 21*b* and the blind port 21*c*.

The ports 27*a*-27*c* are held and clamped by the holder 13.

The holder 13 and the filling nozzles 11*a*-11*d* are then moved towards each other.

This can be done by raising the holder 13 and/or by lowering the head part 19 with the filling nozzles 12*a*-12*d*.

The filling nozzles 12*a* to 12*d* are immersed in the ports 27*a*-27*c* and the bag 20 can then be filled with, for example, three different components of a medical liquid. In one embodiment, the filling nozzles 12*a* to 12*d* are immersed in the ports 27*a*-27*c* or the filling nozzles 12*a* to 12*d* come into contact with the ports 27*a* to 27*c* in such manner that the filling process is shielded or sealed from the environment. The filling nozzles 12*a* to 12*d* are attached to the ports 27*a* to 27*c* in a sealed manner.

An outer, first filling nozzle 12*a* can be moved laterally together with the valve block 11*a* relative to the other three filling nozzles 12*b*-12*d* (see the double arrow marked in FIG. 1).

Figure 2:
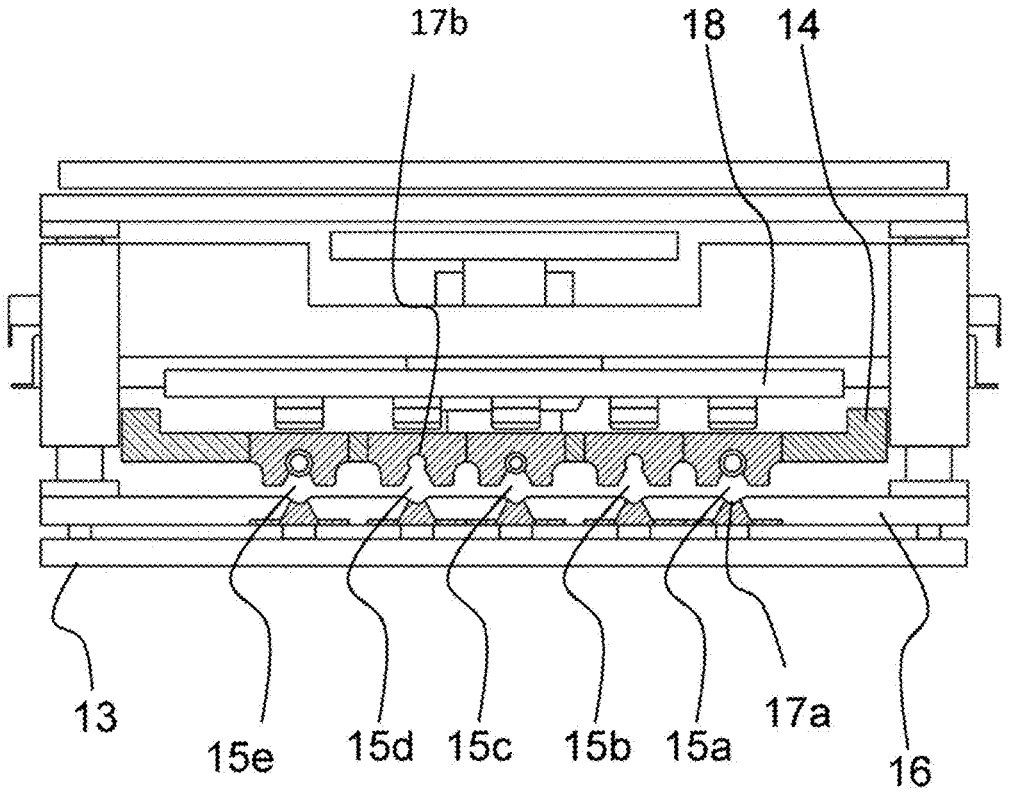
FIG. 2 is a schematic view of the installation from above.

The lateral movement allows the first filling nozzle 12*a* to be moved to two different receptacles 15*a*, 15*b* for a port 27*a* (see FIG. 2).

In the view shown in FIG. 1, the displaceable filling nozzle 12*a* is in an outer position together with the valve block 11*a*.

For a bag 20*d* in which the ports 27*a* and 27*b* have a smaller spacing from one another, the filling nozzle 12*a* can be moved laterally in the direction of the filling nozzle 12*b*. The process is carried out, for example, by means of pneumatics.

FIG. 2 shows schematically the region of the holder 13 of the installation 10 for filling a bag 20.

The holder 13 comprises a receiving strip 14 for the bag 20.

A locking strip 16 is located opposite the receiving strip 14. The locking strip 16 and the receiving strip 14 can be moved towards each other. The recesses formed by the indentations 17*a* of the locking strip 16 and the indentations 17*b* of the receiving strip 14 are thereby closed.

The ports 27*a*-27*c* form a neck with which they are clamped in the recesses. In this example, a total of five receptacles 15*a*-15*e* are formed for the ports 27*a* to 27*c*. One receptacle 15*a*-15*e* is provided for each port 27*a*-27*c*.

According to this embodiment, the first filling nozzle 12*a* can be moved between the receptacle 15*a* and the receptacle 15*b*.

In order to press the lower part 27*a*-27*c* closed before and/or after filling, the holder 13 comprises the clamping strip 18, which can be moved relative to the receiving strip 14. The ports 27*a* to 27*c* can be pressed closed at the neck by means of the clamping strip 18. In this embodiment, the ports 27*a* to 27*c* each have a flexible, clampable region in their neck region.

Figure 3:
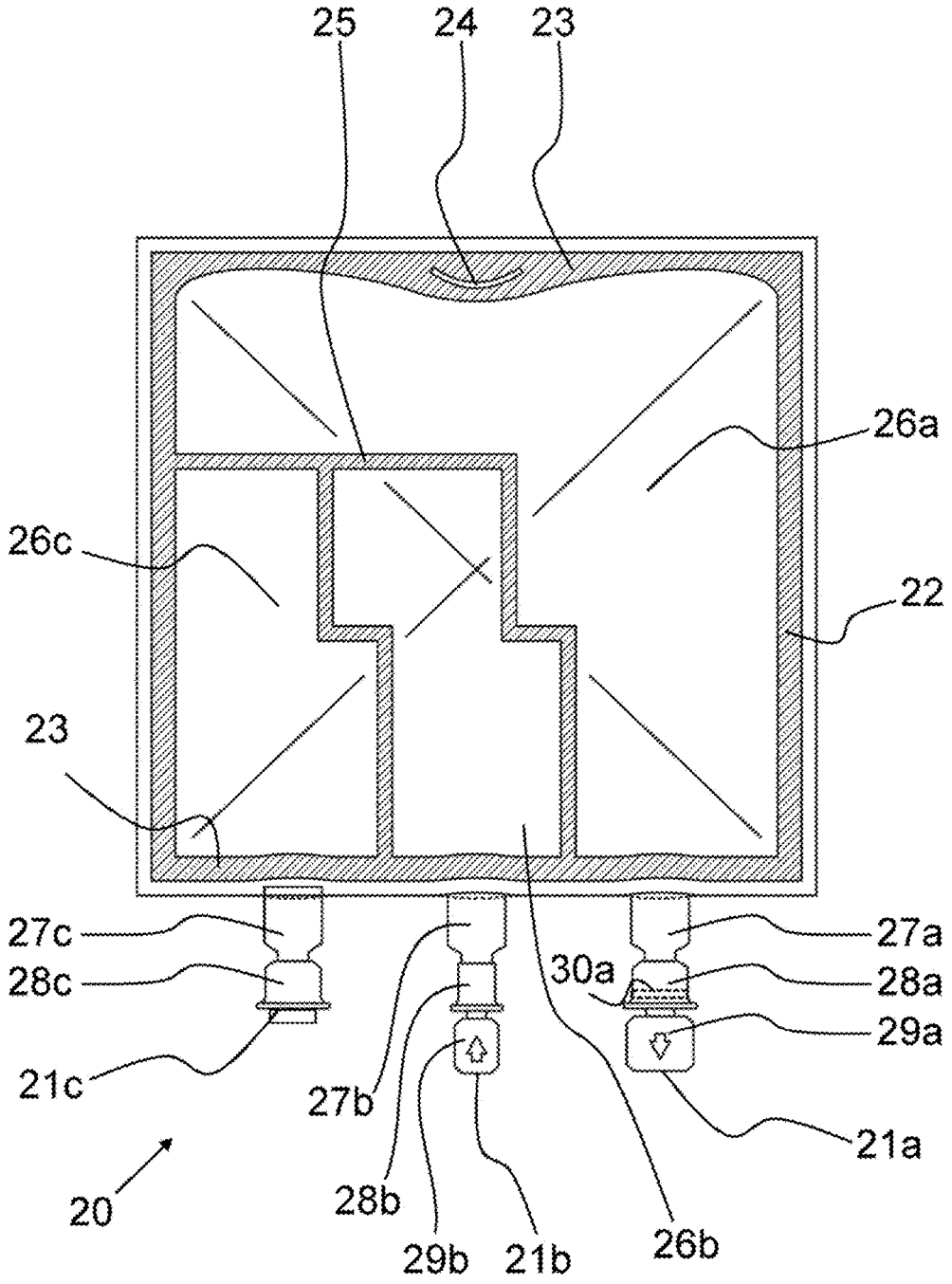
FIG. 3 shows a three-chamber bag and FIG. 4 a two-chamber bag.

FIG. 3 shows a bag 20, which in this embodiment is designed as a three-chamber bag.

The bag is made of films welded via the longitudinal and transverse weld seams 22, 23. The bag 20 comprises a hanger 24 with which it can be suspended from a rack when the infusion solution contained in the bag 20 is removed.

The bag 20 is divided into three chambers 26*a*-26*c* via pull-open weld seams 25. For example, the individual components of a parenteral nutrition solution can be located in these chambers 26*a*-26*c*.

The three ports 27*a*-27*c* are welded into a transverse weld seam 23 of the bag. The ports 27*a*-27*c* each comprise a welded piece. The welded piece is the lower section of the port and forms a foot section. The previously mentioned flexible, clampable region is arranged between the welded piece and the head region of a port.

An upper part 28*a* to 28*c* is placed, in particular pressed, onto the lower part 27*a*-27*c* or the port 27*a*-27*c* in order to form a connector 21*a*-21*b* or a blind port 21*c*. A sealing element 30*a* (only represented schematically for the port 27*a*) is pressed in between the lower part 27*a* to 27*c* and the upper part 28*a* to 28*c*.

The connector 21*a* is used for removal and the connector 21*b* is used for addition of liquid. The connector 21*a* and the connector 21*b* each have a break-off cap 29*a*, 29*b*. After removing the respective break-off cap 29*a*, 29*b*, the sealing element 30*a* can be pierced with a needle or a spike.

The port 27*a* can have a larger diameter than the port 27*b*, via which a liquid can be added in a smaller quantity, such as a medication. The port 27*c* serves only to fill the chamber 26*c*. The upper part 28*c* of the blind port 21*c* is therefore only designed as a closure cap without a break-off part.

Figure 4:
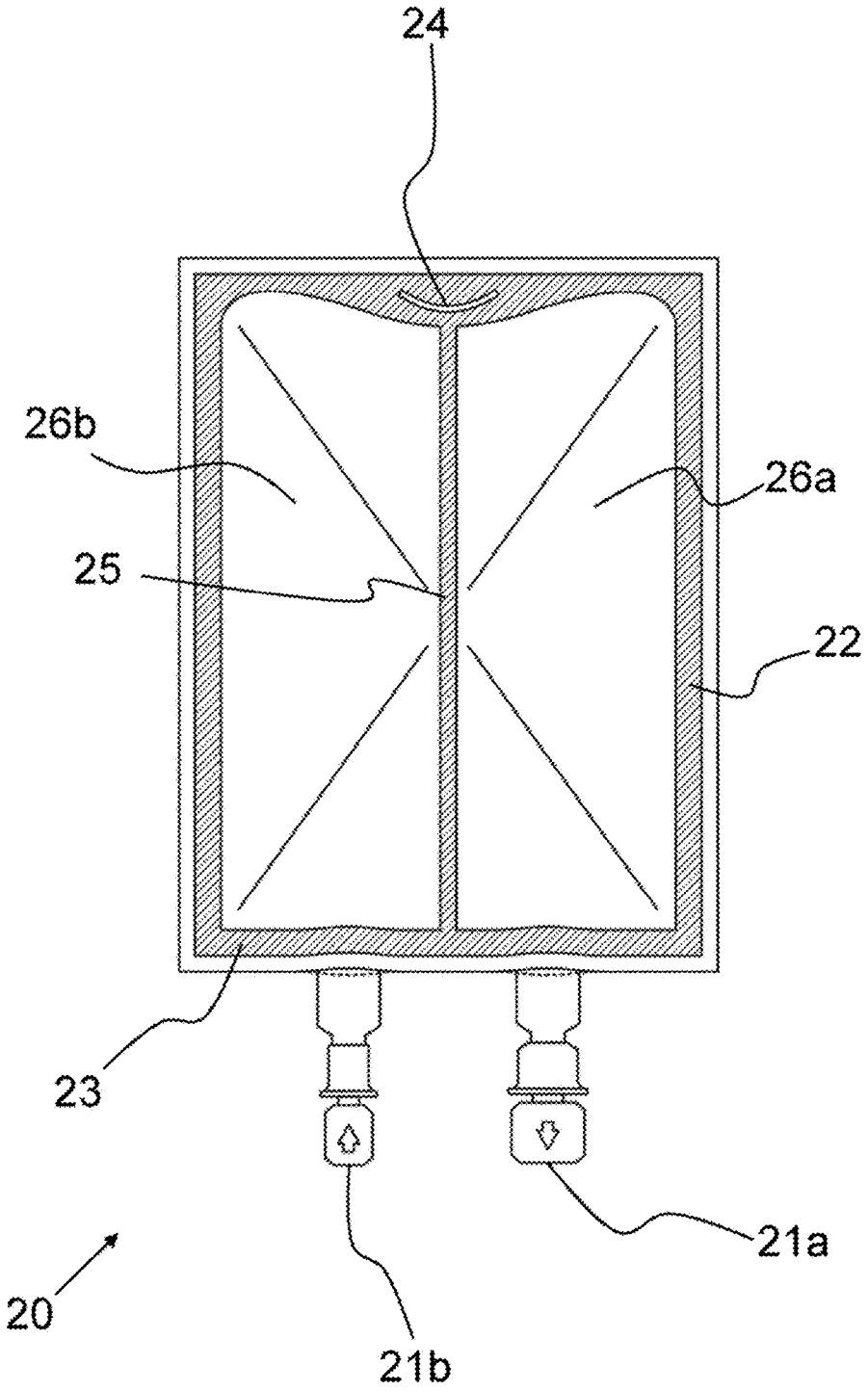

The two-chamber bag represented in FIG. 4 is divided into the two chambers 26*a*, 26*b* by only one pull-open weld seam 25.

This bag is also designed as a film bag with longitudinal and transverse weld seams 22, 23 and a hanger 24.

The two-chamber bag 20 comprises only the two connectors 21*a* and 21*b*, of which the connector 21*a* serves as a removal port and the connector 21*b* as an injection port.

Figure 5:
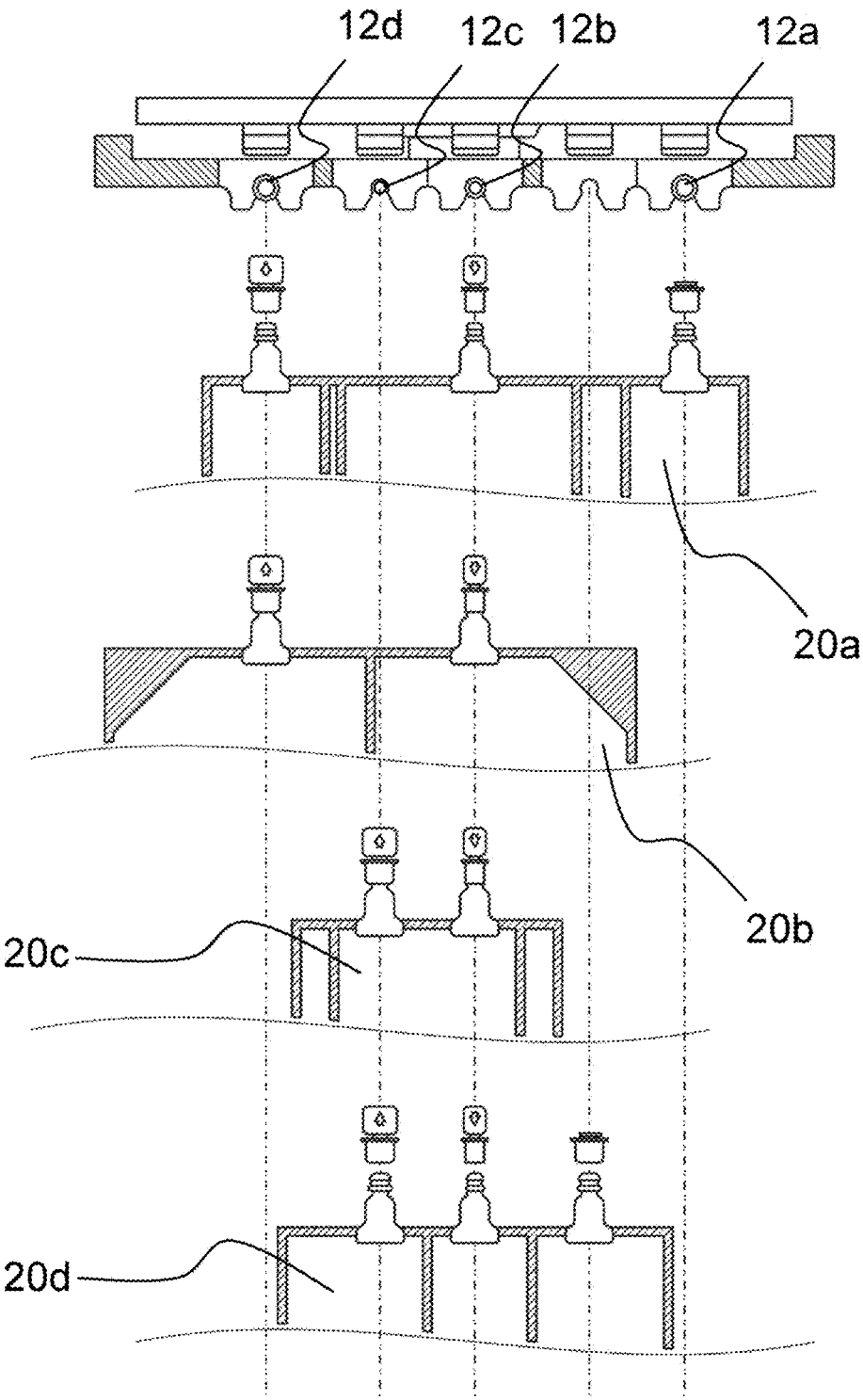
Referring to FIG. 5, a schematic representation is shown to illustrate the use of the installation for different bags.

FIG. 5 shows schematically the flexible use of the installation 10 for filling a bag for differently designed bags 20*a*-20*d*. The installation 10 comprises the filling nozzles 12*a* to 12*d*.

The bag 20*a* is designed as a three-chamber bag. To fill the bag 20*a*, the first filling nozzle 12*a* is moved into the outer position. The bag 20*a* can thus be filled with the filling nozzles 12*a*, 12*b* and 12*d*. The filling nozzle 12*c* is not used for the bag 20*a*.

The bag 20*b* is a two-chamber bag whose removal and injection ports (27*a*, 27*b*) have the same spacing as in the bag 20*a*. This bag 20*b* can be filled by means of the filling nozzles 12*b* and 12*d*. The filling nozzles 12*a* and 12*c* are not used.

The single-chamber bag 20*c* has a smaller port spacing than the two-chamber bag 20*b* and the three-chamber bag 20*d* has a smaller port spacing to the adjacent port with respect to all ports than the bag 20*a*.

The bag 20*c* can be filled by using the adjacent filling nozzles 12*b* and/or 12*c*.

To fill the small three-chamber bag 20*d*, the first filling nozzle 12*a* is moved laterally into its inner position in the direction of the filling nozzle 12*c*. The small three-chamber bag 20*d*, which may be intended in particular for paediatric use, can now be filled via the filling nozzles 12*a*, 12*b* and 12*c*.

The installation 10 can therefore fill at least four bags with different port configurations.

Figure 6:
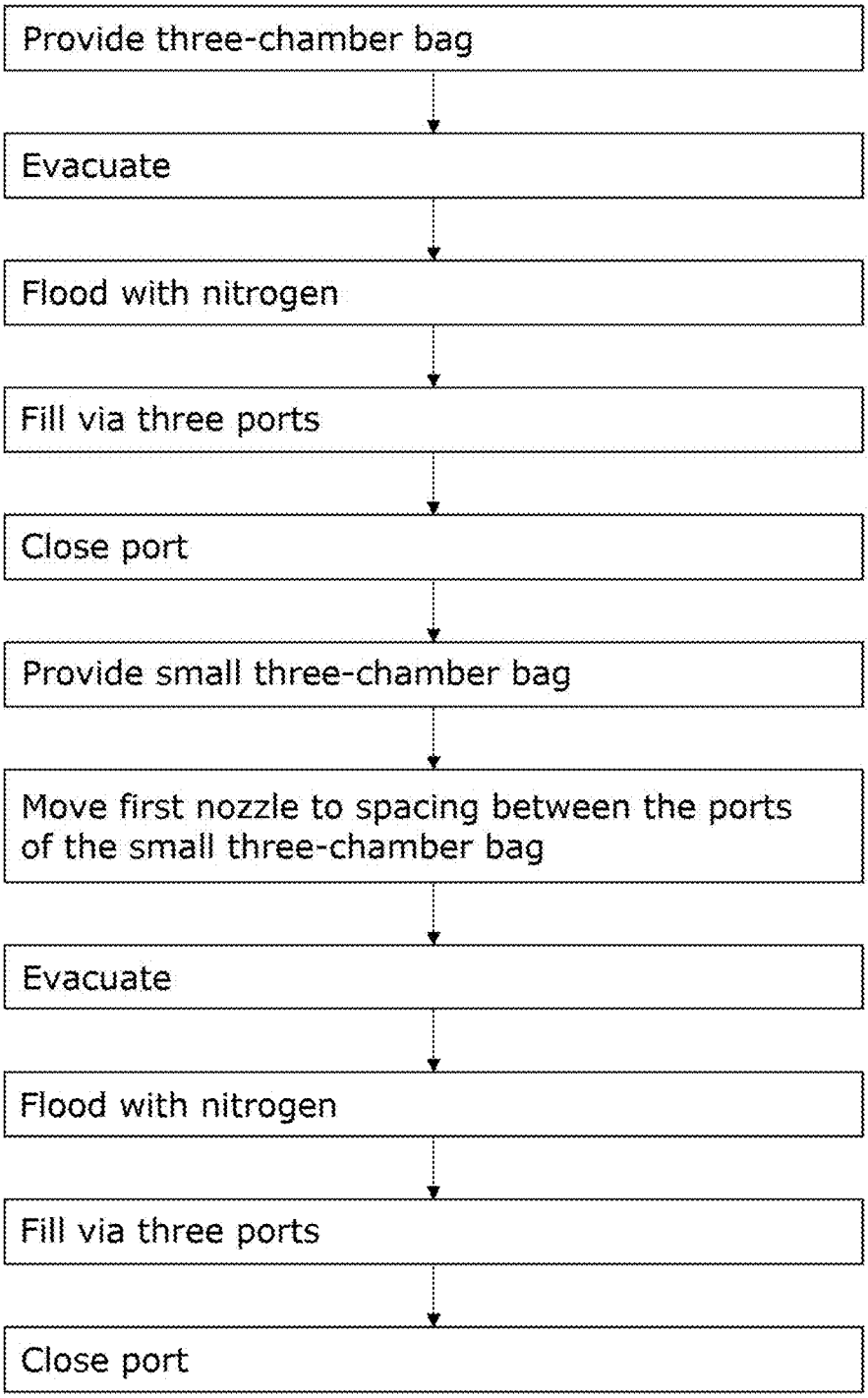
FIG. 6 is a flow chart of an exemplary embodiment of the method according to the invention.

FIG. 6 shows the method steps according to an exemplary embodiment of the invention.

First, a three-chamber bag 20*a* is provided, which is to be filled, for example, with a parenteral nutrition solution for an adult.

The bag 20 is first evacuated and then flooded with nitrogen.

The three-chamber bag 20*a* is then filled via three ports 27*a*-27*c*, with the ports 27*a*-27*c* being gassed with an inert gas, for example nitrogen, during filling. This creates a local atmosphere around the filling region.

The ports 27*a*-27*c* of the three-chamber bag are then closed.

The installation 10 is then to be used to fill a three-chamber bag 20*d*, which is smaller than the three-chamber bag 20*a* described above and in which all three ports 27*a*-27*c* are each located closer to an adjacent port.

For this purpose, the first filling nozzle 12*a* is moved inwards. It is now located at the further inner receptacle 15*b*. Here, the port 27*c* is filled (see also FIG. 3 in conjunction with FIG. 5).

The smaller spacing between the other two ports 27*a* and 27*b* (see FIG. 3 in conjunction with FIG. 5) is compensated by the fact that they are now located at the receptacles 15*c* and 15*d*, whereas the receptacle 15*e* remains free (see FIG. 2).

The smaller three-chamber bag 20*d* is also preferably evacuated, flooded with nitrogen, filled via the three ports 27*a*-27*c* and lastly closed.

The invention provides an installation with which multi-chamber bags with different volumes and/or with a different port spacing can be filled in a very flexible manner.

LIST OF REFERENCE NUMERALS

10 Installation for filling a bag
11*a*-11*d* Valve block
12*a* First filling nozzle
12*b* Second filling nozzle
12*c* Third filling nozzle
12*d* Fourth filling nozzle
13 Holder
14 Receiving strip for the bag
15*a*-15*e* Receptacle for one port
16 Locking strip
17*a*,17*b* Indentation
18 Clamping strip
19 Head part
20 Bag
20*a*-20*d* Bag
21*a* Connector/removal connector
21*b* Connector/injection connector
21*c* Blind port
22 Longitudinal weld seam
23 Transverse weld seam
24 Hanger
25 Pull-open weld seam
26*a*-26*c* Chamber
27*a*-27*c* Port/lower part of the connector or blind port
28*a*-28*c* Upper part
29*a*-29*b* Break-off cap
30*a* Sealing element

The invention claimed is:

1. A filling system comprising:
a bag comprising a first port and a second port;
a first filling nozzle configured to connect to the first port; and
a second filling nozzle laterally spaced from the first filling nozzle, the second filling nozzle being configured to connect to the second port, wherein:
the first filling nozzle is configured to be moved laterally relative to the second filling nozzle, and
the filling system is configured to:
fill a first component of a medical liquid into the bag, via the first filling nozzle and the first port, with the first filling nozzle connected to the first port and the second filling nozzle connected to the second port, and
fill a second component of the medical liquid into the bag, via the second filling nozzle and the second port, with the first filling nozzle connected to the first port and the second filling nozzle connected to the second port.

2. The filling system of claim 1, further comprising a drive that is configured to move the first filling nozzle laterally.

3. The filling system of claim 1, wherein only the first filling nozzle is configured to be moved laterally.

4. The filling system of claim 1, wherein:
the first filling nozzle is configured to be moved to at least two positions,
the system further comprises a plurality of receptacles, and
each of the plurality of receptacles is arranged at one of the at least two positions.

5. The filling system of claim 1, further comprising a plurality of receptacles, and each of the receptacles of the plurality of receptacles comprises a clamp for pressing closed at least one of the first port or the second port.

6. The filling system of claim 1, wherein the fill system is configured to:
fill the first component of the medical liquid into the bag aseptically; and
fill the second component of the medical liquid into the bag aseptically.

7. The filling system of claim 1, wherein the fill system is a rotary installation.

8. The filling system of claim 1, wherein:
the first filling nozzle and the second filling nozzle are arranged on a head of the bag,
the fill system further comprises a plurality of receptacles, and
the head of the bag is configured to be moved vertically relative to the plurality of receptacles.

9. The filling system of claim 1, wherein the bag defines a first chamber that is in fluid communication with the first port and a second chamber that is in fluid communication with the second port.

10. The filling system of claim 1, further comprising a third filling nozzle laterally spaced apart from the first filling nozzle and the second filling nozzle.

11. The filling system of claim 1, further comprising a plurality of receptacles configured to be moved vertically relative to the first filling nozzle and the second filling nozzle arranged on a head of the bag.

12. The filling system of claim 2, wherein the drive is an electric drive, a pneumatic drive, or a hydraulic drive.

13. A filling system for filling a bag with a medical liquid, the filling system comprising:

a plurality of filling nozzles comprising:

a first filling nozzle that is configured to fill a first component of the medical liquid into the bag via a first port of the bag; and a second filling nozzle laterally spaced from the first filling nozzle, the second filling nozzle being configured to fill a second component of the medical liquid into the bag via a second port of the bag; and a plurality of receptacles, wherein:

the first filling nozzle is configured to move laterally relative to the second filling nozzle, and each of the receptacles is configured to receive at least one of the first port of the bag or the second port of the bag, and a number of the receptacles of the plurality of receptacles is at least one greater than a number of the filling nozzles of the plurality of filling nozzles.

14. A filling system for filling at least three different bags, that each have a different number of ports, with a medical liquid, wherein the ports of each of the at least three different bags are spaced apart from one another by different distances, the filling system comprising:

a first filling nozzle that is configured to fill a first component of the medical liquid into at least one the at least three different bags via a first port of the at least one the at least three different bags; and a second filling nozzle laterally spaced from the first filling nozzle, the second filling nozzle being configured to fill a second component of the medical liquid into the at least one the at least three different bags via a second port of the at least one the at least three different bags.

15. A method for aseptically filling a bag with a medical liquid, the method comprising:

providing the bag comprising a first port and a second port;

laterally moving a first filling nozzle relative to a second filling nozzle to adjust a spacing between the first filling nozzle and the second filling nozzle to correspond to the spacing between the first port and the second port;

filling a first component of the medical liquid into the bag using the first filling nozzle that is in fluid communication with the first port; and filling a second component of the medical liquid into the bag using the second filling nozzle that is in fluid communication with the second port.

16. The method of claim 15, wherein the bag defines a first chamber that is in fluid communication with the first port and a second chamber that is in fluid communication with the second port.

17. The method of claim 15, further comprising at least one of:

flooding the bag with nitrogen before filling the first component of the medical liquid and filling the second component of the medical liquid; or gassing the first port and the second port with nitrogen during filling the first component of the medical liquid and filling the second component of the medical liquid.

18. The method of claim 15, further comprising closing the first port and the second port with a sealing element.

19. The method of claim 18, further comprising packaging the bag within a secondary package after filling the first component of the medical liquid into the bag and after filling the second component of the medical liquid into the bag.

* * * * *